US006083140A

United States Patent [19]

Kimura

[11] Patent Number: 6,083,140

[45] Date of Patent: Jul. 4, 2000

[54] PNEUMATIC VALVE SPRING SYSTEM HAVING A SINGLE AIR COMPRESSOR TO ALSO SUPPLY AIR ACTUATED ACCESSORIES

[75] Inventor: Takaaki Kimura, Iwata, Japan

[73] Assignee: Yamaha Hatsudoki Kabushiki Kaisha, Iwata, Japan

[21] Appl. No.: 08/558,163

[22] Filed: Nov. 15, 1995

[30] Foreign Application Priority Data

Nov. 16, 1994 [JP] Japan ..... 6-308331

[51] Int. Cl.[7] ..... F01L 1/24

[52] U.S. Cl. ..... 477/115; 477/34; 123/90.14; 123/90.27; 123/90.65

[58] Field of Search ..... 477/34, 115, 156; 123/90.65, 198 R, 198 C

[56] References Cited

U.S. PATENT DOCUMENTS

| | | | |
|---|---|---|---|
| 3,771,388 | 11/1973 | Ishihara et al. . | |
| 4,129,404 | 12/1978 | Korner et al. | 417/364 |
| 4,499,793 | 2/1985 | Jow et al. . | |
| 4,612,826 | 9/1986 | Greene | 477/33 |
| 4,688,530 | 8/1987 | Nishikawa et al. | 123/198 R |
| 4,823,647 | 4/1989 | Simonyi et al. | 477/81 |
| 4,915,598 | 4/1990 | Kubis | 417/380 |
| 4,974,557 | 12/1990 | Gebhardt | 123/65 B |
| 5,058,541 | 10/1991 | Shibata et al. | 123/90.65 X |
| 5,216,989 | 6/1993 | Iwata et al. | 123/198 R X |
| 5,233,950 | 8/1993 | Umemoto et al. | 123/90.65 X |
| 5,419,412 | 5/1995 | Schwab et al. | 477/79 X |
| 5,515,675 | 5/1996 | Bindschatel | 60/370 |
| 5,529,028 | 6/1996 | Weikert | 123/198 R X |

FOREIGN PATENT DOCUMENTS

| | | |
|---|---|---|
| 2627131 | 8/1989 | France . |
| 2631078 | 11/1989 | France . |

*Primary Examiner*—Khoi Q. Ta
*Attorney, Agent, or Firm*—Knobbe, Matens, Olson & Bear LLP

[57] ABSTRACT

An internal combustion engine having an engine camshaft driven air compressor. The air compressor supplies air under pressure through separate regulated and controlled circuits to air springs for urging the poppet valves of the engine to a closed position and engine driven accessories, such as a variable throttle mechanism and/or an air actuator for controlling for a change speed transmission.

9 Claims, 3 Drawing Sheets

PNEUMATIC VALVE SPRING SYSTEM HAVING A SINGLE AIR COMPRESSOR TO ALSO SUPPLY AIR ACTUATED ACCESSORIES

BACKGROUND OF THE INVENTION

This invention relates to an internal combustion engine and more particularly to an improved pneumatic valve spring arrangement for such engines.

It has been recognized that the speed at which a reciprocating engine operates can be significantly increased through the use of pneumatic-type valve springs. By utilizing air pressure to close the valves rather than the more conventional coil springs, the engine can be operated at higher speeds. This is because the pneumatic spring does not have the resonant characteristics as coil springs which reduce the maximum speed at which the engine can operate. In addition, the use of pneumatic springs can provide longer life because the spring mechanism does not deteriorate with age and is not subjected to fatigue failures.

Although it is possible to operate an engine with a charged reservoir in which the air pressure is provided for the springs, a more compact, longer life assembly can be achieved if an air pump is driven off the engine for pressurizing the spring chambers. Of course, this adds to the complexity of the engine.

It is, therefore, a principal object of this invention to provide an improved and simplified air spring arrangement for an internal combustion engine.

It is a further object of this invention to provide an air compression system for an internal combustion engine that operates not only to supply air for air springs of the engine, but also air for operating or controlling other engine accessories.

SUMMARY OF THE INVENTION

This invention is adapted to be embodied in an internal combustion engine having a cylinder block defining at least one cylinder bore and closed at one end by a cylinder head. The cylinder head carries a plurality of poppet-type valves serving the cylinder bore. At least one camshaft is journaled in the cylinder head for operating the poppet valves. Air springs are associated with each of the valves for urging the valves to a closed position in opposition to the action of camshaft. An air compressor is driven directly off one end of the camshaft. At least one air actuated accessory is associated with the engine and a supply system supplies air under pressure to the air springs and the air actuated accessory.

DETAILED DESCRIPTION OF THE PREFERRED EMBODIMENT OF THE INVENTION

Figure 1:
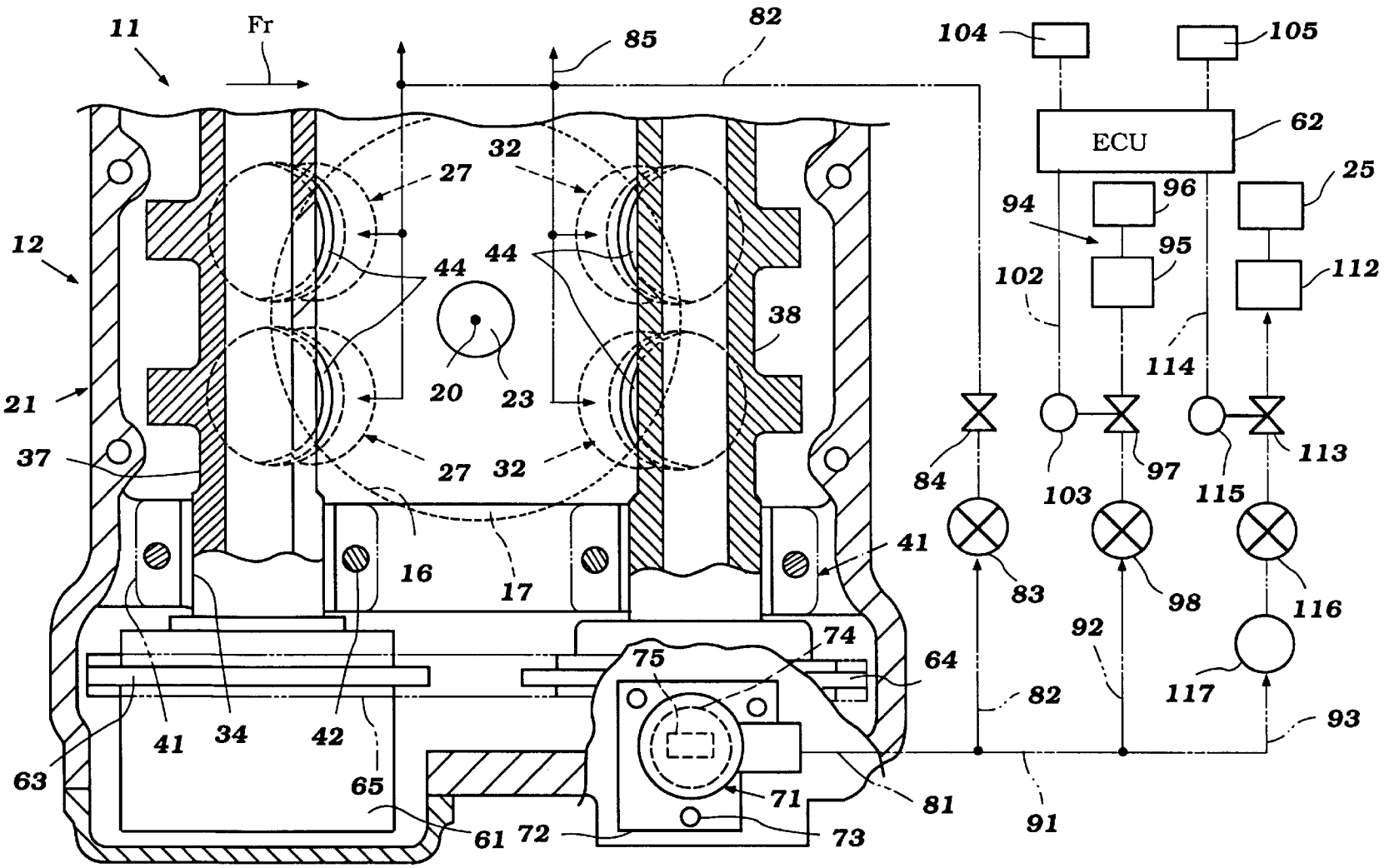
FIG. 1 shows a top plan view taken along the line 1—1 of FIG. 2 of a portion of an internal combustion engine constructed in accordance with an embodiment of the invention with the cylinder head covers removed and portions broken away and shown in section to illustrate the relationship between various internal components and with a number of engine accessories, represented schematically.
Figure 2:
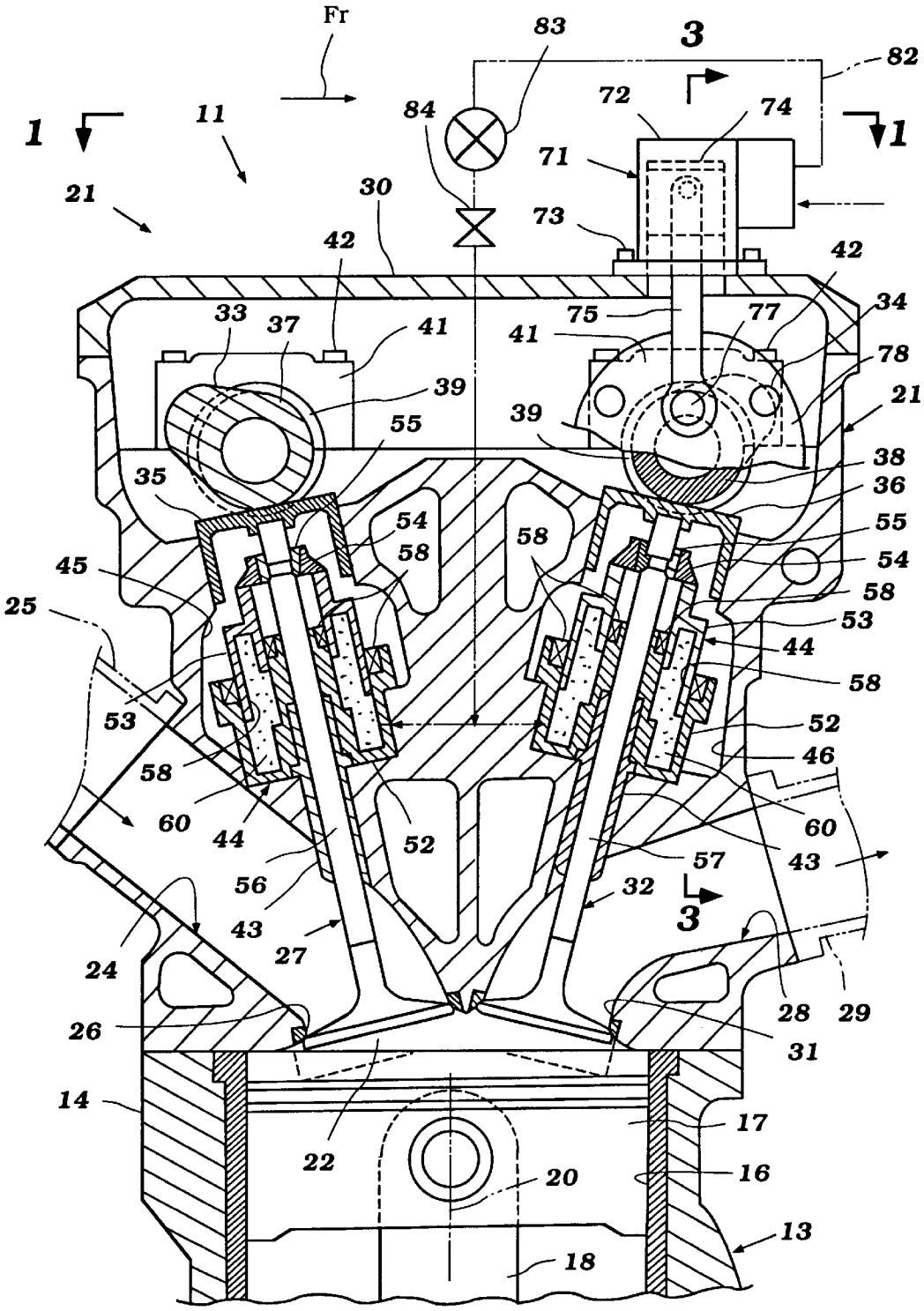
FIG. 2 shows a partial cross-sectional view of the upper portion of the engine and primarily the cylinder head.
Figure 3:
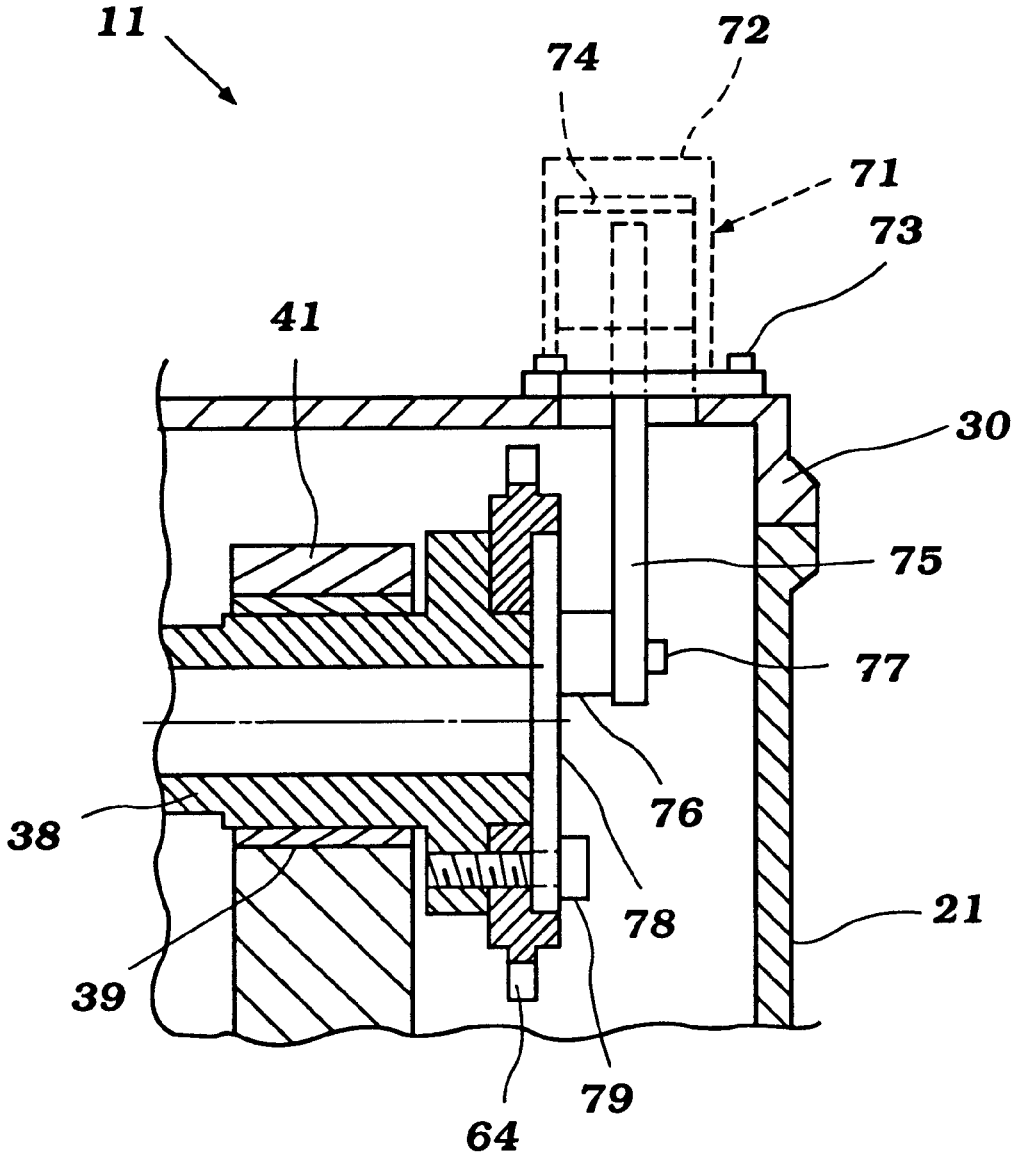
FIG. 3 shows an enlarged front cross-sectional view taken along the line 3—3 of FIG. 2.

Referring now in detail to the drawings and initially to FIGS. 1 and 2, a four cycle internal combustion engine constructed in accordance with the embodiment of the invention is identified generally by the reference numeral 11. The engine 11 may be of any known configuration such as a V-type engine one bank of which is shown an opposed engine or an in-line engine and may have any number of cylinders.

The engine 11 is provided with a cylinder block crankcase assembly indicated generally by the reference numeral 12 and composed of a cylinder block 13 with cylinder banks 14 (only one of which is shown) and a crankcase member (not shown). The crankcase member or oil pan is attached to the under surface of the cylinder block 13 by any suitable means.

The cylinder bank 14 is provided with cylinder bores 16 in which pistons 17 reciprocate. Each piston 17 is pivotally connected by means of a piston pin to the small end of a connecting rod 18. The big end of the connecting rod 18 is journaled on a throw of a crankshaft (not shown) which is rotatably journaled within the crankcase member.

A cylinder head assembly, indicated generally by the reference numeral 21, is affixed to the upper surface of the cylinder bank 14 in any well known manner and enclosed at their top surface by a cam cover 30. The cylinder head 21 has recesses 22 formed in its lower surface above which are positioned spark plugs 23. The spark plugs 23 have their gaps disposed on the axis of the respective cylinder bore 16, which axis is indicated by the line 20.

The recesses 22 align with the cylinder bores 16 and the heads of the pistons 17 to form the individual combustion chambers of the engine 11. The recesses 22 can be referred to as the combustion chambers since at top dead center (TDC) their volume comprises the major portion of the clearance volume.

An intake passage 24 extends through one side of each cylinder head 21 and is served by an intake manifold 25. The intake passage 24 is Siamesed and terminates at its inner side at valve seats 26 which are controlled by intake valves 27.

In a similar manner, a Siamesed exhaust passage 28 extends through the opposite side of each cylinder head 21 and serves an exhaust manifold 29. The exhaust passage 28 begins at valve seats 31 which are controlled by exhaust valves 32.

As can best be seen in FIG. 2, the intake and exhaust valves 27 and 32, respectively, are opened by respective cam lobes 33 and 34 through respective valve tappets 35 and 36. The cam lobes 33 and 34 form a portion of overhead camshafts 37 and 38 that are journaled for rotation in the cylinder heads 21 by bearings 39, housed in caps 41 which are affixed to the cylinder heads 21 by means of bolts 42.

The intake and exhaust valves 27 and 32 are supported for reciprocation in the cylinder heads by means of valve guides 43 that are press fitted into the cylinder head 21 and extend into the intake or exhaust passages 24 or 28 at their lower ends. An air spring assembly, indicated generally by the reference numeral 44, is associated with each valve 27 and 32 for closing the respective valve 27 or 32.

The air spring assemblies 44 are positioned in chambers 45 and 46 formed on the intake and exhaust sides of the cylinder head 21. The air spring assemblies 44 comprise a static spring housing 52 that is press or otherwise fitted into the respective valve chamber 45 or 46 above the valve guide 51 and which nests on the upper portion of the guide 51 in such a manner that the upper inside surface of the static housing 52 also serves as an extended valve guide for the respective valve 27 or 32.

A dynamic spring housing 53 slidingly engages along the circumference of the inner surface of outer wall of the static housing 52. At its upper end the dynamic housing 53 is restrained relative to the stem 56 or 57 of the intake valve 27 or exhaust valve 32 by a valve retainer 54 and keeper 55, which are detachably affixed to the upper portion of the valve stems 56 and 57. Thus, it is apparent that the valves 27 and 32, tappets 35 and 36, dynamic housings 53, retainers 54, and keepers 55 may move as a unit along the stems of the valves 27 and 32, while the guides 51 and static housings 52 maintain a fixed position in the cylinder head 21.

The static and dynamic housings 52 and 53, respectively, define an enclosed volume 60 that is sealed from the external environment by seals 58. Pressurized air is supplied to this volume in a manner to be described later and acts as a spring that closes the valves 27 and 32 and returns them to their seated positions.

A variable timing device 61 is affixed to one end of the intake camshaft 37. The variable timing device 61 is of any conventional type. The timing device 61 controls the cam shaft angle with respect to a drive sprocket 63 in any known manner in relation to engine running conditions under any desired strategy. The sprocket 63 of the intake camshaft 37 is driven along with a further sprocket 64 which is affixed to one end of the exhaust cam shaft 38 by means of a timing chain 65. The timing chain 65 is driven by a crankshaft sprocket (not shown) which drives the sprockets 63 and 64 at one half engine speed.

An air compressor assembly 71 is positioned on top of the cylinder head 21 directly above the exhaust camshaft 38 to which the sprocket 64 is affixed. The air compressor 71 is comprised of a housing 72 which is rigidly affixed to the cylinder head cover 30 by means of bolts 73. A piston 74 reciprocates within a bore formed in the housing 72 and is pivotally connected to the upper portion of a connecting rod 75. The lower end of the connecting rod 75 extends through a hole in the cover 30 and is journaled on a throw 75 which is eccentrically mounted by means of a pin 77 to a disk plate 78. The disk plate 78 is bolted to the end of the exhaust camshaft 37 by bolts 79, which pass through the sprocket 64.

The air compressor 71 receives air from an atmospheric inlet (not shown) compresses it in a known manner and delivers it to a pressure conduit 81. The conduit 81 is connected to a further conduit 82 in which is positioned a shut-off valve 83 located upstream of a pressure regulating valve 84. Downstream of the pressure regulating valve 84, the conduit 82 forms two branches, each of which enters a respective air delivery passage 85 formed in the cylinder head 21. The delivery passages 85 intersect each pneumatic valve spring assemblies 44 through an opening (not shown) in the lower portion of the static housing to supply regulated air pressure to the air pressure chambers 60 to supply the pressure to close the respective valves 27 and 32.

The air compressor 71 in addition to supplying the necessary air under pressure for actuating the air springs 43 and 44 also is used to operate or drive a number of engine accessories as is described below with reference to FIG. 1. An air conduit 91 is connected to conduit 81 where it junctions with conduit 82 and itself branches into two conduits 92 and 93 which respectively serve a transmission 94 and a variable length intake manifold 25 of a conventional or known type.

Conduit 92 serves the transmission 94 and connects at its upper end to one or more gear actuators 95, which in turn, control a change speed, semi-automatic gear box 96. A regulating valve 97, controls the pressure in the conduit 92 and is controlled by the ECU 62 through a connector 102 in which is positioned a valve actuator 103, is positioned in the conduit 92 upstream of the actuator 95 and downstream of a shut-off valve 98. The ECU 62 controls the operation of the transmission 94 based on signals received from an operator controller 104, to shift the transmission 94.

The operation may also be terminated by the shut off valve 98 at any time as deemed necessary. Thus, it is seen that the air compressor assembly 71 provides the transmission 94 with compressed air that serves in the operation of the gearbox 96.

Conduit 93 serves the variable length intake manifold pipe 25 that is divided into upper and lower ends (not shown) which slidingly engage each other. A pneumatic type actuator 112 engages both the upper and lower manifold portions and is connected to a pressure regulating valve 113 that is positioned in conduit 93 and is controlled by the ECU 62 through a connector 114 in which is positioned a valve actuator 115. A shut-off valve 116 is positioned upstream of the regulating valve 113 and downstream of an accumulator 117.

The ECU 62 controls the effective length of the intake pipe 25 based on signals received from the engine operating sensors 105. A signal from the ECU 62 to the valve actuator 115, via connector 114, activates the actuator 115 such that air from the accumulator 117 passes through the shut-off valve 116 and the regulator valve 113 at a pressure that will cause the manifold actuator 112 to position the upper and lower manifold portions in a spacial relationship with each other that is ideally suited for the given engine operating conditions. Thus, for the high engine speed operation, the intake manifold length will be decreased by the ECU 62, whereas for mid and low speed engine operation the manifold length will be increased an appropriate amount by the ECU 62.

It should be readily apparent form the foregoing description that the described construction provides a very compact compressor assembly for an internal combustion engine that supplies air under pressure to actuate or supply an air spring arrangement for the poppet valves of the engine. In addition, the air compressor is utilized to supply air to one or more engine accessories for their actuation.

It should be apparent that the foregoing description is that of a preferred embodiment of the invention and that various changes and modifications may be made without departing from the spirit and scope of the invention, as defined by the appended claims.

What is claimed is:

1. An internal combustion engine comprised of a cylinder block defining at least one cylinder bore, a cylinder head closing said cylinder block and carrying a plurality of poppet-type valves serving said cylinder bore, at least one camshaft journaled in said cylinder head for operating said poppet valves, air springs associated with said valves for urging said valves to a closed position in opposition to the action of said camshaft, an air compressor driven directly off said camshaft, at least one air actuated accessory associated with said engine, and a supply system for supplying air under pressure to said air springs and to said air actuated accessory a shut-off valve interposed between the air compressor and the respective air springs and air actuated accessory for disabling at least one thereof.

2. An internal combustion engine as set forth in claim 1, wherein the air actuated accessory comprises a component of the engine.

3. An internal combustion engine as set forth in claim 2, wherein the engine component comprises a variable throttle mechanism.

4. An internal combustion engine as set forth in claim 1, wherein the air actuated accessory comprises an accessory driven by the engine.

5. An internal combustion engine as set forth in claim 4, wherein the engine driven accessory comprises a transmission.

6. An internal combustion engine as set forth in claim 5, wherein the air actuated accessory controls the shifting of the transmission.

7. An internal combustion engine as set forth in claim 1, further including air pressure regulating means for controlling the air pressure supplied to the air springs and the air actuated accessory.

8. An internal combustion engine as set forth in claim 7, wherein there is provided a separate regulator for each of the air spring and the air actuated accessory.

9. An internal combustion engine comprised of a cylinder block defining at least one cylinder bore, a cylinder head closing said cylinder block and carrying a plurality of poppet-type valves serving said cylinder bore, at least one camshaft journaled in said cylinder head for operating said poppet valves, air springs associated with said valves for urging said valves to a closed position in opposition to the action of said camshaft, an air compressor driven directly off said camshaft, at least one air actuated accessory associated with said engine, a supply system for supplying air under pressure to said air springs and to said air actuated accessory, and air pressure regulating means for controlling the air pressure supplied to said air springs and said air actuated accessory comprising a separate regulator for each of said air springs and said air actuated accessory.

* * * * *